US006845532B1

(12) United States Patent
Rosenblum

(10) Patent No.: US 6,845,532 B1
(45) Date of Patent: Jan. 25, 2005

(54) DISPLAY MATTRESS PROTECTOR

(76) Inventor: Edward A. Rosenblum, 2949 Joyce La., Merrick, NY (US) 11566

( * ) Notice: Subject to any disclaimer, the term of this patent is extended or adjusted under 35 U.S.C. 154(b) by 16 days.

(21) Appl. No.: 10/637,454

(22) Filed: Aug. 8, 2003

(51) Int. Cl.[7] ..... A47C 21/00

(52) U.S. Cl. ..... 5/482; 5/486; 5/907; 40/661; 40/776

(58) Field of Search ..... 40/661, 776; 5/482, 5/484, 487, 496, 497, 498, 499, 501, 907

(56) References Cited

U.S. PATENT DOCUMENTS 2,155,690 A * 4/1939 Simpson ..... 5/498
2,188,576 A * 1/1940 Mulloy ..... 5/498
2,537,652 A * 1/1951 Churchill ..... 5/499
5,020,177 A * 6/1991 Etherington ..... 5/496
5,046,207 A * 9/1991 Chamberlain ..... 5/496
5,221,273 A * 6/1993 Graham ..... 604/358
5,497,521 A * 3/1996 Waits et al. ..... 5/658
5,585,156 A * 12/1996 Fontana ..... 428/43
5,718,010 A * 2/1998 Beier ..... 5/636
6,014,782 A * 1/2000 Stevenson ..... 5/499
6,216,292 B1 * 4/2001 Oakhill et al. ..... 5/482
6,233,762 B1 * 5/2001 Bradley ..... 5/484

* cited by examiner

*Primary Examiner*—Michael Trettel
(74) *Attorney, Agent, or Firm*—G. Victor Treyz

(57) ABSTRACT

Display mattress protectors are provided that protect mattresses in a mattress showroom when customers lie on the mattresses and place their feet on the mattresses. A display mattress protector may be formed from a clear vinyl sheet with reverse-printed promotional information on its lower surface. The promotional information may include a manufacturer's logo. By reverse printing the promotional information on the underside of the mattress protector, the printed information is not subject to wear from the shoes of the customers. Because the sheet is clear, the promotional information is visible to the customers. Because the vinyl is thick, the vinyl does not wrinkle significantly. Shock cord firmly attaches the mattress protector to the mattress. Barbs at the ends of the shock cord attach the shock cord to the vinyl sheet. Cord stoppers are used to make coarse adjustments to the lengths of the shock cord to accommodate different mattresses.

19 Claims, 4 Drawing Sheets

DISPLAY MATTRESS PROTECTOR

BACKGROUND OF THE INVENTION

This invention relates to mattresses, and more particularly to display mattress protectors that can be used to protect mattresses that are shown to the public in mattress showrooms.

Bed mattresses are often sold through retail outlets with mattress showrooms. A customer may peruse the mattresses on display in the showroom and may try out mattresses of interest. For example, the customer may lie on the mattress in street cloths to judge the firmness and quality of the mattress before making a purchase decision.

In mattress showrooms with substantial customer traffic, it is desirable to protect the mattresses, so that the mattresses do not become soiled and unattractive from customer wear. Display mattress protectors are available that may be attached to the mattresses in the showroom. These mattress protectors typically only cover the foot of the mattress, because that is the area that receives substantial wear from customers who do not remove their shoes before trying out a mattress.

Some conventional display mattress protectors carry mattress manufacturer logos, so that the mattress protector can be used to identify a particular brand of mattress while protecting the mattress from wear.

One type of display mattress protector that is currently available is constructed from a sheet of thin clear vinyl (about 8–12 gauge) with a logo printed on its upper surface. Because the logo is printed on the upper (exposed) surface of the mattress protector, the logo is subject to wear from the customers. This type of display mattress protector uses an elastic strip to secure the mattress protector to the mattress. The elastic strip is about three inches wide and is sewn into the vinyl at each end. This elastic fastening arrangement is not readily adjustable, which makes it difficult to accommodate the various thicknesses of mattress that are on the market.

Another type of display mattress protector that is available uses several sheets of thin vinyl that are sewn into a box-like sleeve that fits over the entire end of the mattress. This type of display mattress protector has visible sewn seams and often does not fit the mattress well, resulting in unsightly pleats and bulges.

It is therefore an object of the present invention to provide improved display mattress protectors.

SUMMARY OF THE INVENTION

Display mattress protectors are provided that can be used to help maintain mattresses in good condition despite being exposed to customer traffic in a mattress showroom.

The mattress protectors can be provided in various sizes, such as twin, full, queen, and king sizes. A single mattress protector may also be provided that can accommodate multiple mattress sizes (e.g., both full and queen).

The display mattress protector may be formed from a flexible material such as vinyl. The vinyl may be relatively thick (e.g., 30 gauge), which makes the mattress protector durable and allows the mattress protector to lie flat on the mattress without developing unsightly pleats or bulges.

The mattress protector may be clear. Logos or other promotional information may be printed in reverse on the underside of the mattress protector (i.e., the side of the mattress protector that lies next to the mattress). This arrangement helps to prevent the printing from being damaged during use.

The mattress protector may be attached to the mattress using elastic. For example, the mattress protector may be attached to the mattress using two lengths of shock cord. Shock cord, which is a high-quality elastic cord that is covered in fabric, wears well and may be attached to the mattress protector using a non-sewn attachment mechanism.

With one suitable arrangement, the shock cord or other elastic fastening material may be attached to the mattress protector using barbs. The barbs may be attached to the ends of shock cord before the barbed shock cord is inserted into mating holes in the mattress protector vinyl sheet.

The length of the shock cord attachment pieces may be adjusted. For example, a buckle or other suitable length-adjusting member may be used to allow the shock cord length to be changed. This allows the mattress protector to be customized to fit mattresses of different widths and thicknesses. With one suitable arrangement, the length-adjusting members are formed from cord stoppers.

Further features of the invention, its nature and various advantages will be more apparent from the accompanying drawings and the following detailed description of the preferred embodiments.

DETAILED DESCRIPTION OF THE PREFERRED EMBODIMENTS

Mattresses are often sold in showrooms. In a typical showroom environment, mattresses are available for customers to inspect. Beds may be arranged in a row, each having a different mattress. A customer may choose a mattress to purchase by lying on each mattress of interest. The customer typically lies on the mattresses in street cloths, without removing their shoes. Unless the mattresses on display are protected from contact with the customers' feet, the mattresses will become soiled. Because soiled mattresses are unattractive and may discourage sales, display mattress protectors are often used to protect the displayed mattresses from wear.

Figure 1:
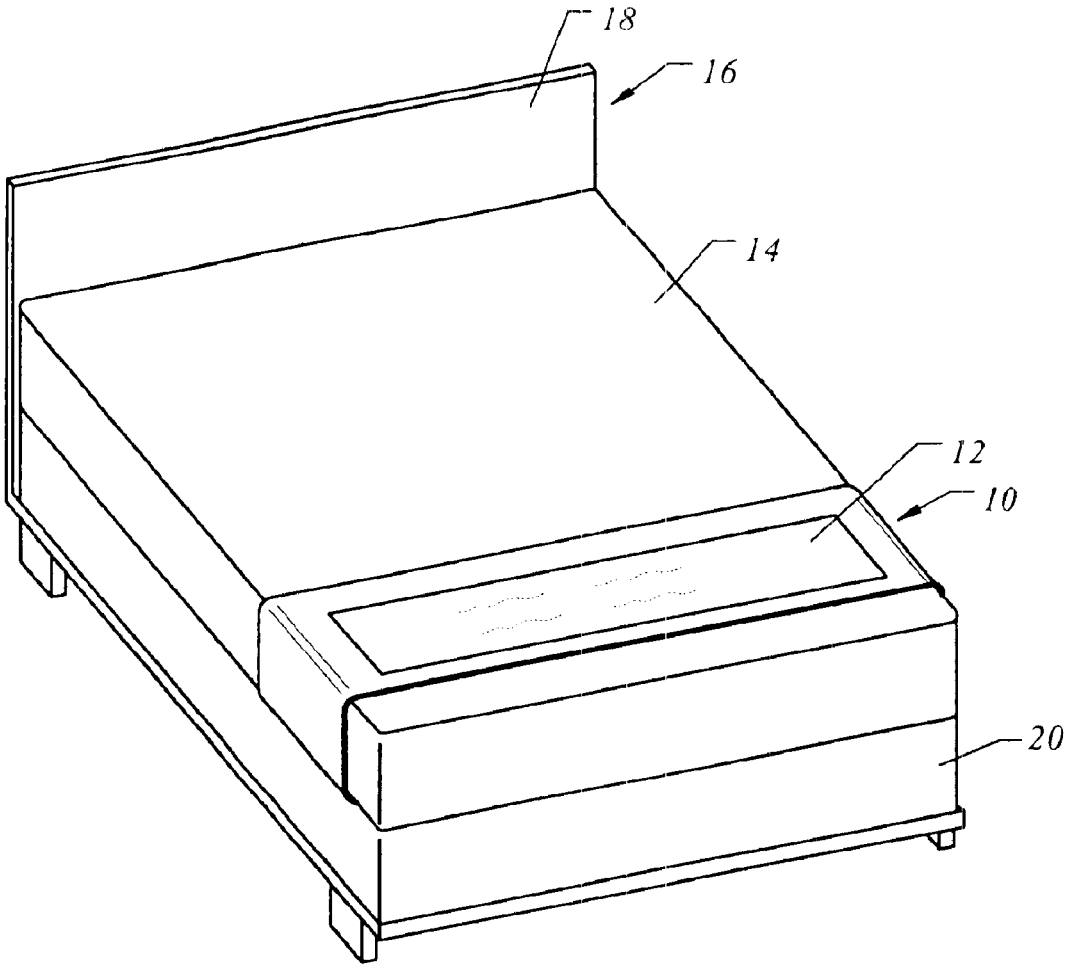
FIG. 1 is a perspective view of an illustrative bed and mattress to which an illustrative display mattress protector has been attached in accordance with the present invention.

An illustrative display mattress protector 10 in accordance with the present invention is shown in FIG. 1. Protector 10 may be made of vinyl or other suitable materials. Promotional information 12 such as manufacturer logos and slogans may be printed on the mattress protector to help identify the mattress being sold and to promote particular products.

The mattress protector 10 wraps around the lower end of the mattress 14. The mattress 14 may be mounted on a bed 16 or other display platform. A typical bed in a showroom may have a frame 18 and a box spring 20. This arrangement is, however, merely illustrative. Mattress protector 10 may be used to protect a mattress 14 regardless of the particular type of frame or platform that is used to support the mattress 14.

When an arrangement of the type shown in FIG. 1 is used, the display mattress protector 10 may extend across the entire width of the end of the mattress 14 and may be tucked into the crack between the mattress 14 and box spring 20. This helps to create a tidy appearance for mattress protector 10 and allows the mattress protector attachment mechanism to be hidden under the mattress, where it is out of view of the customer.

Mattresses come in various sizes and thicknesses. For example, mattresses may come in twin, full, queen, and king sizes. Mattress protector 10 may be made in one or more sizes. For example, mattress protector 10 may be constructed using a one-size-fits-all arrangement. With this approach, the width of the mattress protector may be sufficient to cover a king size mattress (i.e., the largest mattress size). The same size of mattress protector can also be used for twin mattresses (i.e., the smallest mattress size). When the mattress protector is installed on a twin size mattress, the excess width of the mattress protector 10 may be hidden from view by tucking it under the mattress 14. One or more adjustable straps may be used to take up the slack in the mattress protector 10 when a relatively-large one-size-fits-all mattress protector is installed on a small mattress. The width of the promotional information 12 that is printed on the mattress protector 10 can be maintained smaller than the width of a twin mattress, to avoid situations in which the promotional information 12 hangs over the edges of the mattress 10, where it would be difficult to see.

Although a one-size-fits-all arrangement may be used, it is generally preferred to more closely match the size (width) of the mattress protector 10 to the mattress to be protected. With this approach, the mattress protector 10 may be constructed in a series of different sizes, each tailored for a particular corresponding nominal mattress size or a group of two or more nominal mattress sizes. For example, a mattress protector 10 having a relatively small width may be used for twin mattresses, whereas a mattress protector 10 having a relatively larger width may be used for king mattresses.

With one suitable arrangement, mattress protectors have heights (the smaller of their two lateral dimensions) of about 17.5 inches. Twin mattress protectors 10 may have widths (the longer of their two lateral dimensions) of 70". Mattress protectors 10 for double mattresses may be about 86 inches wide. Queen-sized and king-sized mattress protectors 10 may have respective widths of approximately 92 inches and 108 inches. The mattress protectors may be die-cut from rolls of vinyl or other suitable materials.

Different mattress manufacturers construct their mattresses differently. Mattresses of a standard type (e.g., mattresses having a nominal size of "queen") may therefore vary considerably in thickness. To accommodate mattresses of different thickness and/or to accommodate mattresses of different standard sizes (twin, full, queen, etc.), mattress protector 10 may be adjustable in size.

Figure 2:
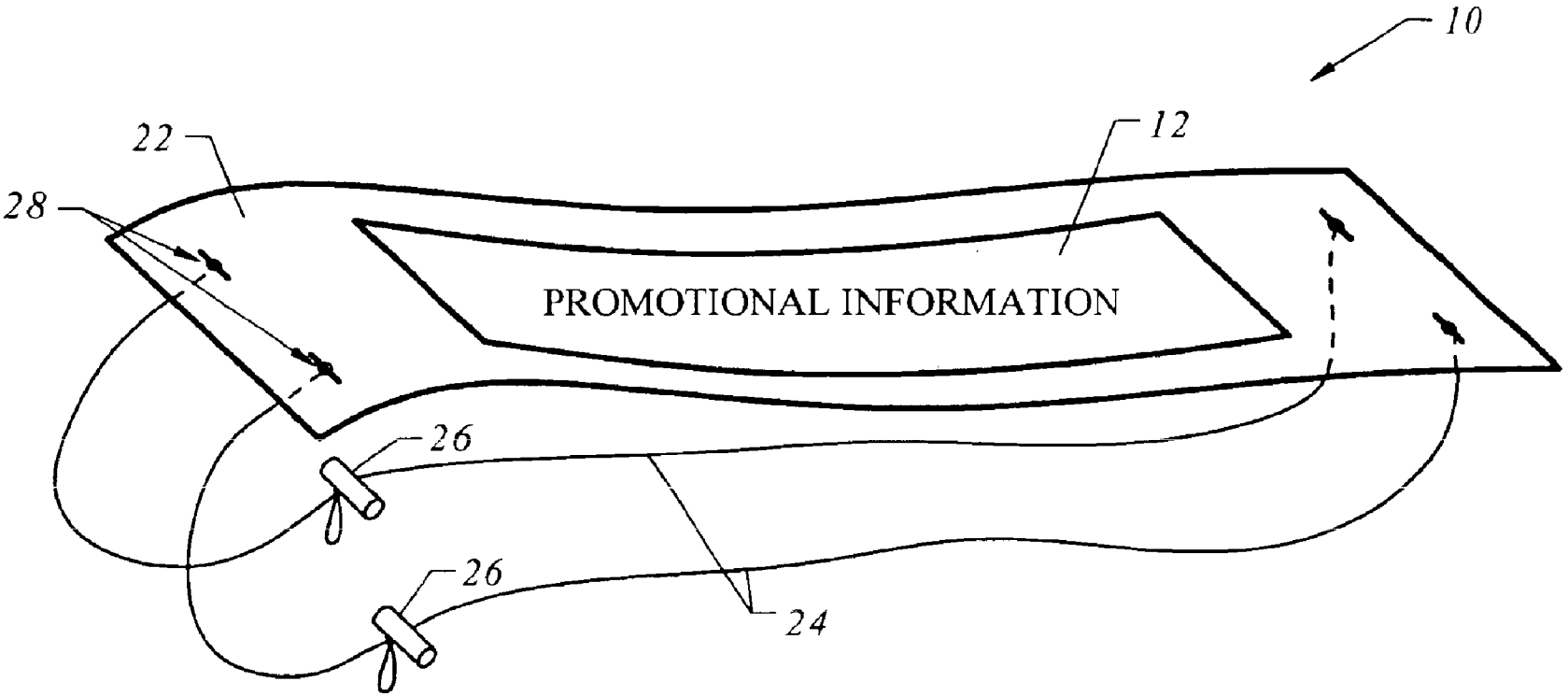
FIG. 2 is a perspective view of an illustrative display mattress protector showing how the mattress protector may have adjustable elastic straps for attaching the mattress protector to the mattress and may have promotional information such as the logo of a particular brand of mattress in accordance with the present invention.

An illustrative arrangement for an adjustable mattress protector 10 is shown in FIG. 2. Mattress protector 10 may be made from a sheet 22 of material. Sheet 22 is preferably flexible, so that the sheet 22 is not too disruptive to the customer when the customer is testing a mattress and so that the ends of the sheet 22 can be tucked under the mattress 10 during use. Sheet 22 may be formed from a flexible polymer or any other suitable substance. Sheet 22 is preferably formed from vinyl, because this is a readily-available material that accepts printing from commercially-available vinyl inks and because vinyl is sufficiently durable to withstand repeated contact from customers' shoes.

Vinyl sheet 22 is preferably clear (i.e., so-called double-polished clear), so that the promotional information 12 can be printed on the underside of the vinyl sheet, rather than on exposed top surface. With a clear sheet 22, the printing on the reverse side of the sheet 22 can be viewed from the top. To ensure that text in the promotional information is readable by the customer, the promotional information is printed in reverse (backwards). When the promotional information is printed in reverse on the backside of the sheet 22, the promotional information will appear with the correct orientation when viewed through the clear sheet from the top of the mattress during use. If desired, translucent sheets (with or without reverse-side printing), opaque sheets, patterned or textured sheets, composite sheets, and other types of sheets may be used for sheet 22 of mattress protector 10.

Promotional information 12 may be applied to sheet 22 using any suitable technique. With a preferred approach, vinyl ink is applied using the silk-screen method. Vinyl inks (silk-screen-compatible inks that adhere well to vinyl) are available from vendors such as Coates Screen, a division of Sun Chemical of East Rutherford, N.J. Inks may be solid, translucent, metallic, etc. Ink may be applied using a solid-color approach (so-called flat color) in which color is applied in a binary yes/no fashion or may be applied using a gradient-approach (so-called process printing) in which subtler gradations of ink are applied allowing photo-type images to be rendered. Although screen-printed vinyl ink is a preferred material for applying promotional information 12 to sheet 22, other suitable techniques may be used if desired.

The promotional information 12 on the mattress protector 10 may include a logo or other information that helps to promote the brand of the mattress manufacturer on whose mattress the mattress protector 10 is to be installed. The promotional information can include logos (e.g., mattress manufacturer logos), tag lines, slogans, text, graphics, informative information (e.g., mattress features such as firmness level, care instructions, mattress construction details, etc.), co-branding information (e.g., information promoting a particular store for which the mattress protector 10 is constructed), or any other suitable text and graphics. An advantage of listing mattress features on the mattress protector 10 is that this avoids the necessity of providing a separate cardboard or sticker insert with the mattress feature information.

Sheet 22 is preferably fairly thick, which makes the mattress cover 10 lie flat on the mattress. With one suitable arrangement, sheet 22 is constructed from 30 gauge vinyl (for reference, 80 gauge vinyl is ¼ inch thick). With 30 gauge vinyl, sheet 22 has an attractive high-quality appearance when lying on mattress 14. Conventional mattress protectors are constructed of thin vinyl sheets of about 8 or 12 gauge vinyl, which is more susceptible to puckering and indentations. In contrast, mattress protector 10 is formed from a thicker-gauge material (e.g., 20–40 gauge, 30–40 gauge, 25–35 gauge, 30 gauge, etc.) which withstands undesirable wrinkling during use. Although considerably more expensive than thinner-gauge materials, double-polished vinyl of about 30 gauge thickness is particularly suitable for mattress protector 10 because it is more robust than thinner materials and enhances the esthetics of the mattress protector 10 without becoming so thick as to be rigid. Rigid sheets 22 may be used for mattress protector 10 if desired, but are generally less preferred than thick flexible sheets 22, because rigid sheets feel less natural under the customer's feet when they are trying out the mattress 14.

The flexible sheet 22 may be secured to the mattress using flexible attachment cords or elastics 24. Conventional mattress protectors use elastic bands of about 3 inches in thickness, but these bands are not adjustable in length beyond the adjustment provided by their inherent flexibility and use sewn connections for attachment to the vinyl sheet. Accordingly, sewing operations are used when fabricating such conventional mattress protectors, which can be complicated and difficult to reverse (e.g., in the event that a misaligned sewn connection needs to be corrected).

Display mattress protector 10 of FIG. 2 uses elastic or other suitable flexible cords 24 to provide elasticity and uses adjustment members 26 to make coarse adjustments to the lengths of the cords 24. The cords 24 may be attached to sheet 22 using barbs 28 or other suitable attachment members.

A preferred type of elastic to use for elastic members 24 is shock cord. Shock cord is a high-quality heavy-duty fabric-covered elastic cord. Shock cord generally has a circular cross-section and can withstand heavy loads and substantial wear without failing. Shock cord is also suitable for use with barbs 28 and allows length adjustment using length-adjustment members 26. Shock cord is available commercially from vendors such as Ross Mathews, Inc. of Fall River, Mass.

Shock cord 24 may be, for example, ⅛ inch in diameter (or any other suitable size such as 1/16–¼ inch in diameter, etc.). Shock cord 24 may be covered in white fabric, white fabric with black trim, or any other suitable fabric.

The shock cord 24 (or other suitable elastic cords or members that are used for mattress protector 10) may be attached to sheet 22 using any suitable attachment mechanism (e.g., by forming knots at the ends of the cord 24, sewing, etc.). With a preferred arrangement, the ends of the shock cord 24 are provided with barbs 28. Barbs 28 may be formed from metal or other suitable materials. An advantage of using pliable metal for barbs 28 is that this allows barbs 28 to be attached to the end of shock cord 24 by crimping the barbs.

Figure 3A:
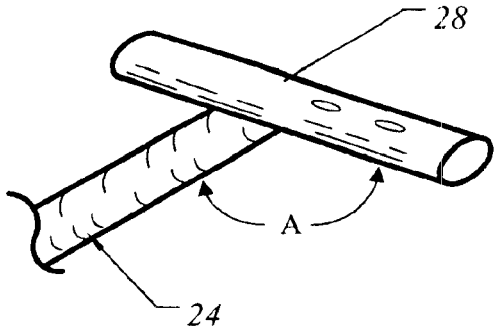
FIG. 3*a* is a perspective view of an illustrative barbed arrangement that may be used to anchor the ends of the adjustable elastic straps in accordance with the present invention.
Figure 3B:
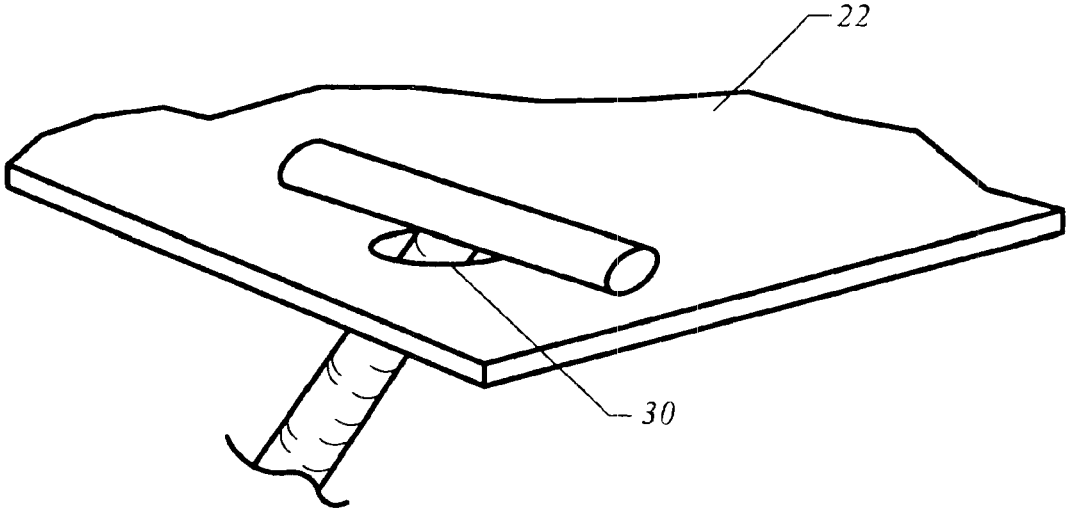
FIG. 3*b* is a perspective view of the illustrative barbed arrangement of FIG. 3*a* after insertion through a mating hole in the display mattress protector in accordance with the present invention.

As shown in FIG. 3*a*, after a barb 28 has been attached to the end of shock cord 24, the barb 28 can pivot so that the longitudinal axis of the barb 28 is at a non-zero angle A with respect to the longitudinal axis of the end of the shock cord 24. As shown in FIG. 3*b*, sheet 22 may have a number of holes 30 (e.g., one hole at each of the four corners of the rectangular sheet 22). During assembly of the mattress protector, the barbs 28 may be folded down so that they are parallel to the ends of the shock cord 24. After the ends of the shock cord and the attached barbs have been threaded through the holes 30, the barbs 28 can be allowed to pivot free, until they are oriented at nearly right-angles to the end of the shock cord 24, as shown in FIG. 3*b*. This arrangement prevents barbs 28 from slipping through the holes 30.

Anchoring the shock cord 24 using the arrangement of FIGS. 3*a* and 3*b* is advantageous, because no sewn connections are required, the connection point is reversible (e.g., if a frayed cord 24 needs to be replaced in the field), and the connection is compatible with circular-cross-section shock cord. The shock cord and barbs may be pre-fabricated so that final assembly of the mattress protector 10 only involves the relatively straightforward operation of threading the barbed shock cord members of appropriate lengths through the holes 30 in the vinyl mattress protector sheet 22.

The shock cord 24 preferably has enough slack to accommodate mattresses of different sizes. For example, if a one-size-fits-all or a one-size-fits-many approach is used for the mattress protector sheet size, the shock cord 24 is preferably able to be adjusted to accommodate all of the needed sizes. The overall length of the shock cord can also be coarsely adjusted to accommodate the different mattress thicknesses provided by different mattress manufacturers. The elasticity of the shock cord 24 provides finer length-adjustment capabilities and holds the mattress protector firmly against the mattress without slipping.

Figure 4:
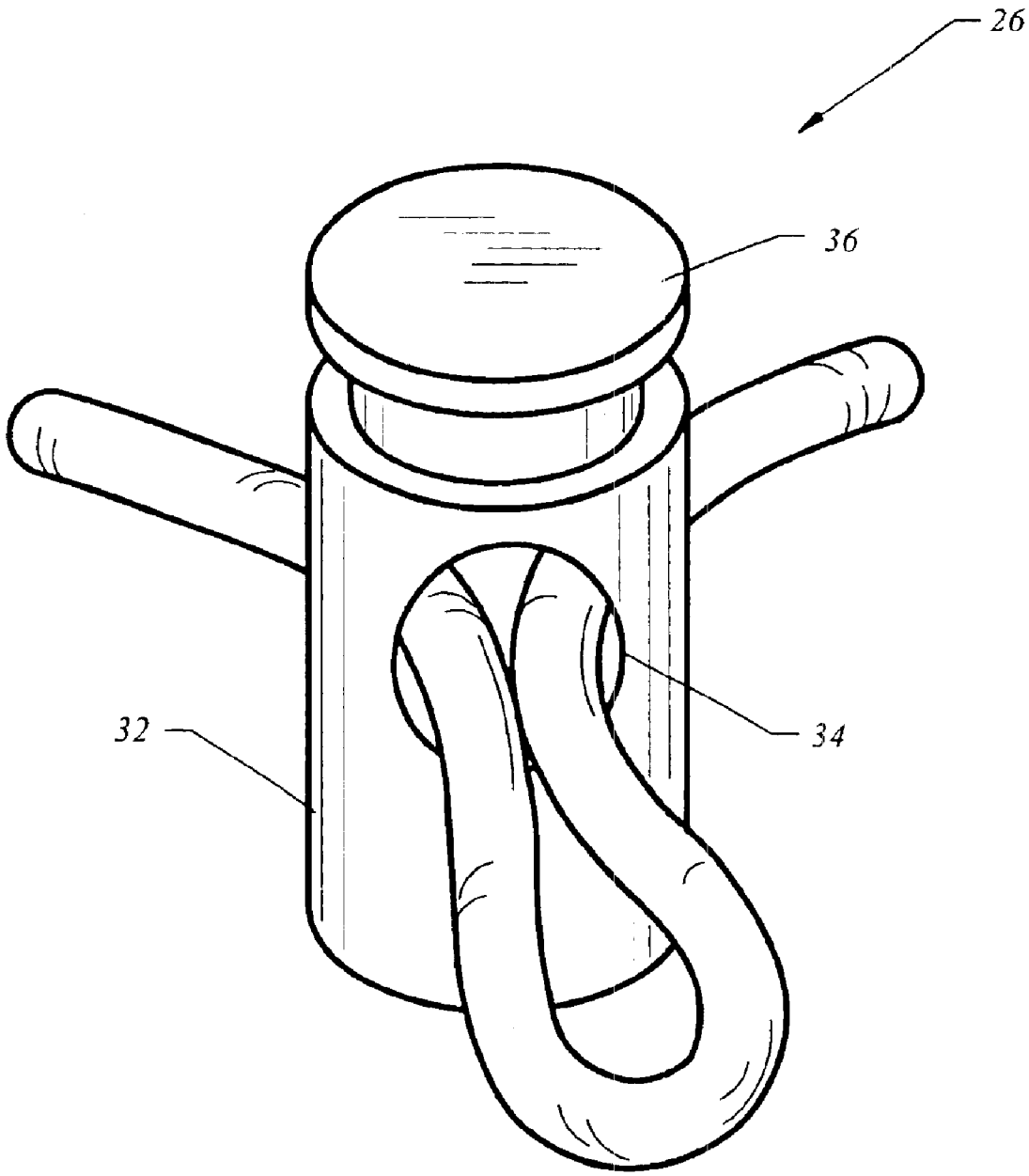
FIG. 4 is a perspective view of an illustrative cord stopper that may be used to provide coarse adjustability to the overall length of the elastics of the display mattress protector in accordance with the present invention.

Coarse adjustments to the overall shock cord length may be made using any suitable length-adjustment mechanism (e.g., a buckle, etc.). With one suitable approach, cord stoppers 26 are used to provide mattress protector 10 with length adjustment capabilities. An illustrative cord stopper 26 is shown in FIG. 4. The illustrative cord stopper 26 of FIG. 4 has a cylindrical body 32 with a perpendicular cylindrical bore 34. A loop of unused (excess) cord 24 may be inserted through bore or hole 34 when the spring-loaded plunger has been depressed, to clear the bore. After the cord 24 has been loaded through the bore 34, the spring-loaded plunger 36 may be released. The spring biases the lower portion of the plunger against the cord 24, thereby holding the cord firmly between the plunger and the upper portion of hole 34. This fixes the length of the unused cord loop and adjusts the overall length of cord.

When shock cord 24 has a diameter of about ⅛ inch, the cord stoppers 26 may be, for example, 8 mm cord stoppers. (The size of a cord stopper refers to the diameter of hole 34). Cord stoppers 26 are relatively inexpensive and are readily available from numerous commercial sources. Cord stoppers 26 are also compatible with shock cord 24, which is a preferred type of elastic strap for securing mattress protector 10 to the mattress 14.

The foregoing is merely illustrative of the principles of this invention and various modifications can be made by those skilled in the art without departing from the scope and spirit of the invention.

What is claimed is:

1. A display mattress protector that is attached to a mattress to protect the mattress from customer wear when customers are placing their feet on the mattress while testing the mattress in a showroom, the display mattress protector comprising:

a flexible sheet;

at least one elastic cord having an overall length, wherein the elastic cord is attached to the flexible sheet to secure the display mattress protector to the mattress; and a length-adjusting member attached to the elastic cord that holds an adjustable length of unused cord in a loop, so that the overall length of the elastic cord can be adjusted to fit the display mattress protector to the mattress, wherein the elastic cord comprises two parallel elastic cords each having two ends that are attached to the flexible sheet at respective corners of the sheet.

2. The display mattress protector defined in claim 1 wherein the elastic cord comprises shock cord.

3. The display mattress protector defined in claim 2 wherein the length-adjusting member comprises a cord stopper.

4. The display mattress protector defined in claim 1 wherein the length-adjusting member comprises a cord stopper.

5. The display mattress protector defined in claim 1 wherein the length-adjusting member comprises a cord stopper having a spring-loaded plunger that allows the cord to either be held in place in the cord stopper or to be slid through the cord stopper to adjust the length of the loop.

6. A display mattress protector that is attached to a mattress to protect the mattress from customer wear when customers are placing their feet on the mattress while testing the mattress in a showroom, the display mattress protector comprising:

a flexible sheet;

at least one elastic cord having an overall length, wherein the elastic cord is attached to the flexible sheet to secure the display mattress protector to the mattress; and a length-adjusting member attached to the elastic cord that holds an adjustable length of unused cord in a loop, so that the overall length of the elastic cord can be adjusted to fit the display mattress protector to the mattress, wherein the flexible sheet comprises vinyl having a thickness in the range of 20 to 40 gauge.

7. The display mattress protector defined in claim 6 wherein the flexible sheet comprises a clear sheet.

8. A display mattress protector that is attached to a mattress to protect the mattress from customer wear when customers are placing their feet on the mattress while testing the mattress in a showroom, the display mattress protector comprising:

a flexible sheet;

at least one elastic cord having an overall length, wherein the elastic cord is attached to the flexible sheet to secure the display mattress protector to the mattress; and a length-adjusting member attached to the elastic cord that holds an adjustable length of unused cord in a loop, so that the overall length of the elastic cord can be adjusted to fit the display mattress protector to the mattress, wherein there are two cords that secure the flexible sheet to the mattress, each of the two cords having two respective ends, and wherein the flexible sheet is rectangular and has a hole at each corner of the sheet, the display mattress protector further comprising crimped metal barbs on each end of each of the two cords that attach the cords to the sheet at the holes.

9. A display mattress protector that is attached to a mattress to protect the mattress from customer wear when customers are placing their feet on the mattress while testing the mattress in a showroom, the display mattress protector comprising:

a flexible sheet;

at least one elastic cord having an overall length, wherein the elastic cord is attached to the flexible sheet to secure the display mattress protector to the mattress; and a length-adjusting member attached to the elastic cord that holds an adjustable length of unused cord in a loop, so that the overall length of the elastic cord can be adjusted to fit the display mattress protector to the mattress, wherein the flexible sheet is double-polished clear vinyl with a printed mattress manufacturer logo, wherein the cord comprises at least two cords each of which has crimped metal barbs that attach the cords to the flexible sheet, wherein the cords comprise shock cord, and wherein the length-adjusting member comprises at least one cord stopper with a spring-loaded plunger.

10. A display mattress protector that is attached to a mattress to protect the mattress from customer wear when customers are placing their feet on the mattress while testing the mattress in a showroom, the display mattress protector comprising:

a clear sheet having an upper surface and a lower surface, wherein there is printed promotional information printed in reverse on the lower surface; and at least one cord that is attached to the clear sheet to secure the display mattress protector to the mattress.

11. The display mattress protector defined in claim 10 wherein the cord comprises fabric-covered elastic shock cord.

12. The display mattress protector defined in claim 10 wherein the cord has ends and wherein the clear sheet has a plurality of holes through which the ends of the cord pass, the mattress protector further comprising barbs connected to the ends of the cord that keep the ends of the cord from slipping from the holes.

13. The display mattress protector defined in claim 12, wherein the barbs comprise metal barbs that are crimped onto the ends of the cord.

14. The display mattress protector defined in claim 10 wherein there are two cords for attaching the display mattress protector to the mattress, wherein each cord has two respective ends that are fastened to two respective corners of the clear sheet.

15. The display mattress protector defined in claim 10 wherein the cord has an overall length, the mattress protector further comprising at least one length-adjustment member on the cord that grips the cord to form a loop of unused cord length, thereby allowing coarse adjustments to the overall length of the cord.

16. The display mattress protector defined in claim 10 wherein the cord has an overall length, the display mattress protector further comprising at least one cord stopper attached to the cord for making coarse adjustments to the overall length of the cord.

17. The display mattress protector defined in claim 10 wherein the clear sheet has a thickness of between 20 and 40 gauge.

18. The display mattress protector defined in claim 10 wherein the promotional information comprises mattress features and wherein the cord comprises elastic cord.

19. A display mattress protector that is attached to a mattress to protect the mattress from customer wear when customers are placing their feet on the mattress while testing the mattress in a showroom, wherein the mattress has a width, the display mattress protector comprising:

a clear rectangular sheet of double-polished clear vinyl having a width at least as large as the mattress width and having a thickness in the range of 20–40 gauge, wherein the rectangular sheet has an upper surface and a lower surface and has printed promotional information printed in reverse on the lower surface using vinyl ink so that the promotional information is not contacted by the feet of the customers, wherein the promotional information includes at least one mattress manufacturer's logo printed in reverse, and wherein there is a hole at each corner of the rectangular sheet;

two fabric-covered elastic shock cords each having two ends and each having an overall length, wherein the ends of the shock cords pass through the holes in the rectangular sheet and wherein the two shock cords extend under the mattress to hold the rectangular sheet in place against the mattress; and a cord stopper on each of the two fabric-covered elastic shock cords for making adjustments to the overall length of each cord by holding a loop of unused cord.

* * * * *